US011137704B2

(12) United States Patent
Taguchi

(10) Patent No.: US 11,137,704 B2
(45) Date of Patent: Oct. 5, 2021

(54) FIXING DEVICE AND IMAGE FORMING APPARATUS

(71) Applicant: BROTHER KOGYO KABUSHIKI KAISHA, Nagoya (JP)

(72) Inventor: Kazuna Taguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/125,090

(22) Filed: Dec. 17, 2020

(65) Prior Publication Data

US 2021/0200127 A1 Jul. 1, 2021

(30) Foreign Application Priority Data

Dec. 27, 2019 (JP) ..... JP2019-238911

(51) Int. Cl.
*G03G 15/00* (2006.01)
*G03G 15/20* (2006.01)
*G03G 21/16* (2006.01)

(52) U.S. Cl.
CPC ..... *G03G 15/2053* (2013.01); *G03G 15/2064* (2013.01); *G03G 15/757* (2013.01); *G03G 21/1647* (2013.01)

(58) Field of Classification Search
CPC ..... G03G 15/2053; G03G 15/2064; G03G 15/757; G03G 21/1647; F16H 1/20; F16H 1/28; F16H 15/04; F16H 3/50; F16H 3/52
See application file for complete search history.

(56) References Cited

U.S. PATENT DOCUMENTS

2008/0044203 A1 2/2008 Ukai
2009/0169259 A1* 7/2009 Ebara ..... G03G 21/1647 399/167
2016/0062299 A1* 3/2016 Hirose ..... G03G 15/1615 74/434

FOREIGN PATENT DOCUMENTS

JP 61-099849 U 6/1986
JP 6-48606 A 2/1994
JP 2001-173642 A 6/2001
JP 2006-251269 A 9/2006
JP 2008-046549 A 2/2008
JP 2010-262231 A 11/2010

* cited by examiner

*Primary Examiner* — Hoang X Ngo
(74) *Attorney, Agent, or Firm* — Merchant & Gould P.C.

(57) ABSTRACT

In a fixing device, a first fixing member and a second fixing member in combination forms a nip, a first gear receives a driving force from a main gear provided in an image forming apparatus, a second gear rotates together with the first gear about a center of rotation of the first gear, a third gear provided in mesh with the second gear rotates together with the first fixing member. The first gear and the second gear are rotatably supported by a metal shaft. The first fixing member and the metal shaft are supported by a side frame. A sleeve is provided around the metal shaft. A material of the second gear and a material of the sleeve have melting points higher than a melting point of a material of the first gear, and the first gear is supported via the sleeve by the metal shaft.

20 Claims, 10 Drawing Sheets

FIXING DEVICE AND IMAGE FORMING APPARATUS

CROSS-REFERENCE TO RELATED APPLICATION(S)

This application claims priority from Japanese Patent Application No. 2019-238911 filed on Dec. 27, 2019, the disclosure of which is incorporated herein by reference in its entirety.

TECHNICAL FIELD

Apparatuses disclosed herein relate to a fixing device for fixing a developer image on a sheet, and an image forming apparatus including the fixing device.

BACKGROUND ART

An image forming apparatus comprising a housing and a fixing device housed in the housing is hitherto known in the art. The housing is for example provided with a motor, a drive gear, an idle gear, a metal shaft, and a frame. The fixing device is driven by the motor. The driving force from the motor is transmitted to the drive gear. The idle gear rotatably supported by the metal shaft meshes with the drive gear. The metal shaft is fixed to the frame. The fixing device comprises a heating roller and a heating roller gear. The heating roller gear is fixed on an end portion of the heating roller. The heating roller gear meshes with the idle gear.

SUMMARY

It is conceivable that the aforementioned idle gear may be provided not in the housing but in the fixing device. In this modified configuration, however, the idle gear rotatably supported by the metal shaft fixed to a frame of the fixing device would transmit heat generated in the heating roller through the metal shaft to the idle gear, and melt the idle gear, with the result that nonnegligible noises would be caused by the melted idle gear.

There is a need to provide a fixing device with a gear supported therein by a metal shaft, in which undesirable melting of the gear by heat transmitted through the metal shaft can be restrained.

In one aspect, a fixing device is disclosed herein, which comprises a first fixing member, a second fixing member, a first gear, a second gear, a third gear, a metal shaft, a side frame, and a sleeve. The first fixing member is configured to rotate. The second fixing member is configured to form a nip in combination with the first fixing member. The first gear is configured to receive a driving force from a main gear provided in an image forming apparatus. The second gear is configured to rotate together with the first gear about a center of rotation of the first gear. The third gear is provided in mesh with the second gear and configured to rotate together with the first fixing member. The first gear and the second gear are rotatably supported by the metal shaft, and the roller and the metal shaft are supported by the side frame. The sleeve is provided around the metal shaft. A material of the second gear and a material of the sleeve have melting points higher than a melting point of a material of the first gear. The first gear is supported via the sleeve by the metal shaft.

In another aspect, an image forming apparatus comprising the fixing device as described above is disclosed herein. Specifically, the image forming apparatus comprises a developer image forming unit configured to form a developer image on a sheet, a housing in which the developer image forming unit and the fixing device are housed, and a main gear provided in the housing to transmit a driving force to the fixing device, in addition to the fixing device configured to fix the developer image on the sheet.

With these configurations, the first gear is supported by the metal shaft via the sleeve of a material having a higher melting point, and thus the first gear can be restrained from melting by heat transmitted through the metal shaft.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

Figure 1:
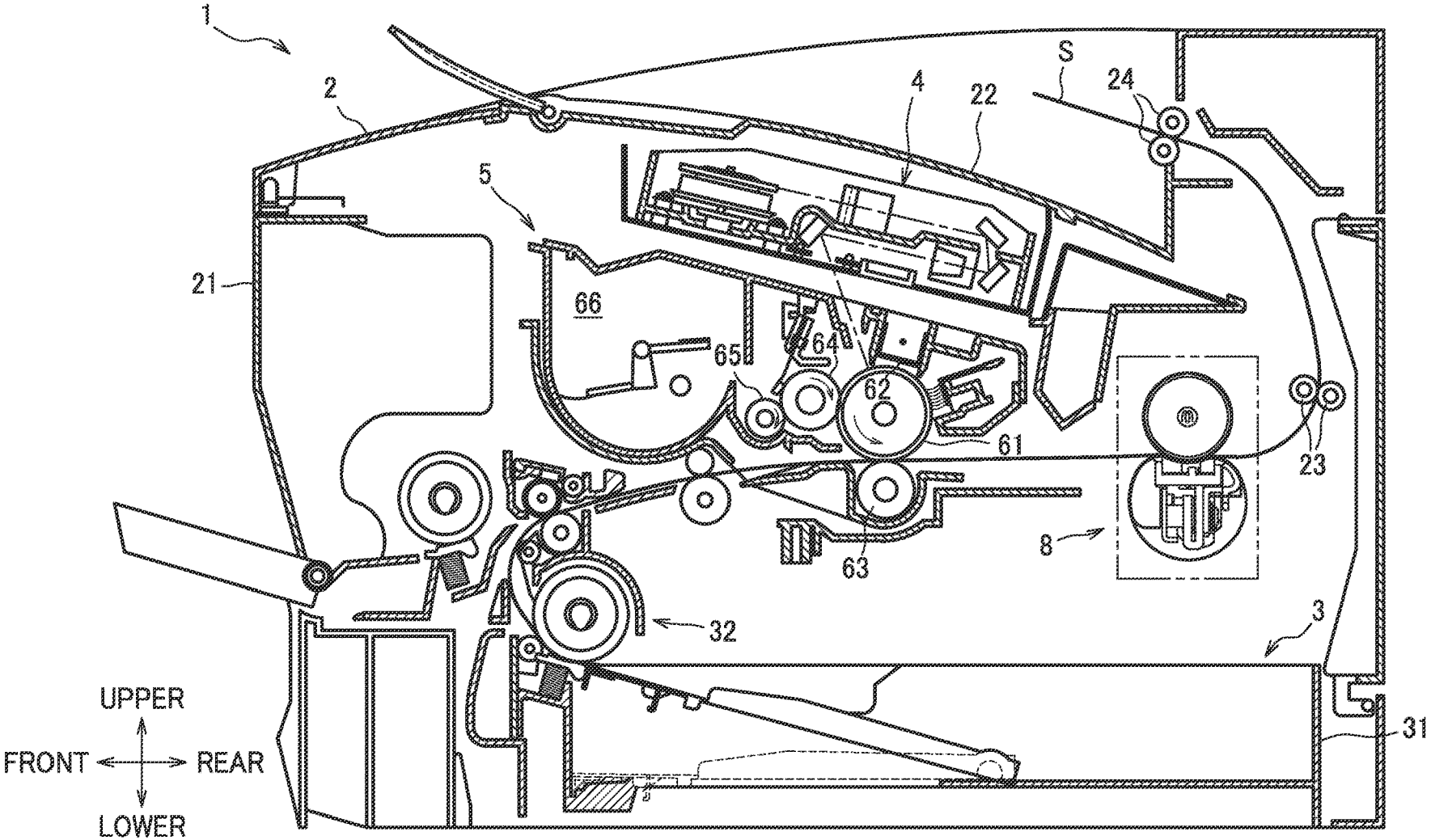
FIG. 1 is a section view of an image forming apparatus.

As shown in FIG. 1, a fixing device 8 illustrated herein is a device used in an image forming apparatus 1 such as a laser printer. The image forming apparatus 1 comprises a housing 2, a sheet feeder unit 3, an exposure device 4, a developer image forming unit 5, and the fixing unit 8. The sheet feeder unit 3, the exposure device 4, the developer image forming unit 5 and the fixing unit 8 are housed in the housing 2.

The sheet feeder unit 3 is provided in a lower space inside the housing 2, and comprises a sheet tray 31 as a receptacle for holding and serving sheets S (e.g., of paper), and a sheet feed mechanism 32. Sheets S in the sheet tray 31 are fed on a one-by-one basis by the sheet feed mechanism 32 to the developer image forming unit 5.

The exposure device 4 is provided in an upper space inside the housing 2, and comprises a light source device (not shown), and a polygon mirror, lenses and reflectors (shown without reference characters). The exposure device 4 is configured to rapidly scan a surface of a photoconductor drum 61 with a light beam (see alternate long and short dashed lines) emitted from the light source device in accordance with image data, to thereby expose the surface of the photoconductor drum 61 to the light beam.

The developer image forming unit 5 is provided under the exposure device 4. The developer image forming unit 5 is configured as a process cartridge, installable into and removable from the housing 2 through an opening which is made available when a front cover 21 attached at a front side of the housing 2 is opened. The developer image forming unit 5 comprises a photoconductor drum 61, a charger 62, a transfer roller 63, a development roller 64, a supply roller 65, and a developer container 66 in which developer composed of dry toner is held.

In the developer image forming unit 5, the surface of the photoconductor drum 61 is uniformly charged by the charger 62. Thereafter, the surface of the photoconductor drum 61 is scanned with a light beam from the exposure device 4, and selectively exposed to light so that an electrostatic latent image formulated in accordance with the image data is formed on the surface of the photoconductor drum 61. Developer in the developer container 66 is supplied via the supply roller 65 to the development roller 64.

In the developer image forming unit 5, developer on the development roller 64 is supplied to the electrostatic latent image formed on the surface of the photoconductor drum 61. Accordingly, the electrostatic latent image is visualized, and a developer image is formed on the surface of the photoconductor drum 61. Thereafter, a sheet S fed from the sheet feeder unit 3 is conveyed through between the photoconductor drum 61 and the transfer roller 63, so that the developer image on the surface of the photoconductor drum 61 is transferred to the sheet S. In this way, the developer image is formed on the sheet S.

The fixing device 8 is provided rearward of the developer image forming unit 5. The features of the fixing device 8 will be described later in detail. The fixing device 8 causes a sheet S with a developer image transferred (formed) thereon to pass therethrough, and thereby thermally fixes the developer image on the sheet S. The image forming apparatus 1 further comprises an output tray 22, conveyor rollers 23 and ejection rollers 24. The output tray 22 is provided outside of the housing 2. The sheet S with the developer image thermally fixed thereon is ejected by the conveyor rollers 23 and the ejection rollers 24 onto the output tray 22.

Figure 2:
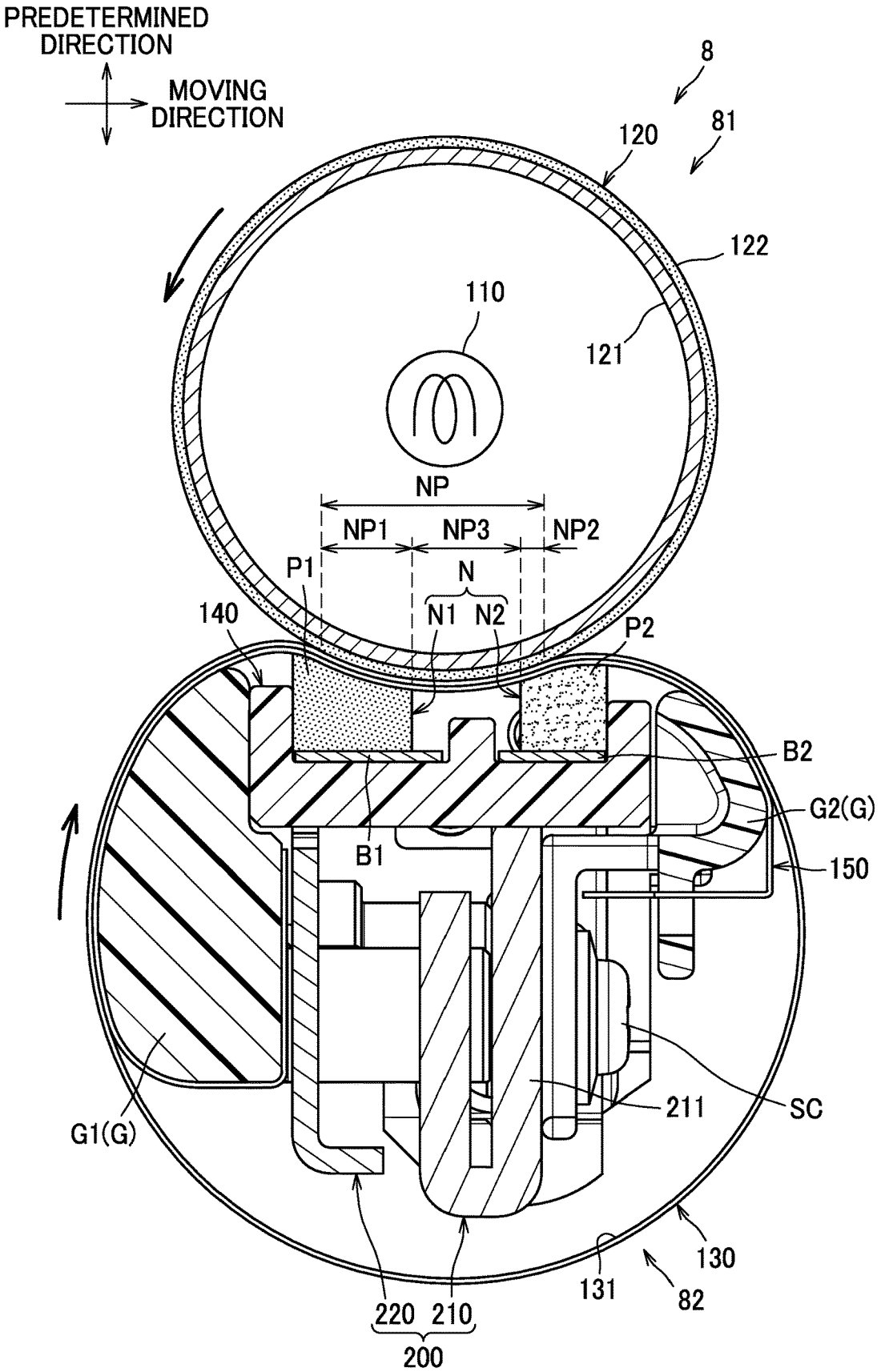
FIG. 2 is a section view of a fixing device.

As shown in FIG. 2, the fixing device 8 comprises a heater 110, a first fixing member 81, a second fixing member 82, and a variable pressure control mechanism 300 (see FIG. 4) of which a detailed description will be given later. The second fixing member 82 is biased toward the first fixing member 81 by the variable pressure control mechanism 300. In the following description, the direction in which the second fixing member 82 is biased toward the first fixing member 81 is referred to as "predetermined direction". The predetermined direction herein is, but not limited to, a direction perpendicular to a width direction and to a moving direction. The "width direction" and "moving direction" will be described below. In other words, the predetermined direction is an orientation aligned parallel to directions in which the first fixing member and the second fixing member face each other.

The first fixing member 81 includes a roller 120 that is rotatable. The second fixing member 82 includes a belt 130, a nip-forming member N, a holder 140, a stay 200, a belt guide G, and a slide sheet 150. The second fixing member 82 is a member configured to form a nip (nip region NP) in combination with the first fixing member 81. The nip region NP is formed between first fixing member 81 and the second fixing member 82. To be more specific, the nip region NP is formed between the roller 120 and the second fixing member 82. The holder 140 and the stay 200 serve as an example of a support member. In this description, the direction of the width of the belt 130 is simply referred to as "width direction". The width direction coincides with a direction of extension of an axis of rotation of the roller 120, that is, an axial direction of the roller 120. The width direction is perpendicular to the predetermined direction.

The heater 110 comprises a halogen lamp which, when energized, generates light and heat. The heater 110 applies its radiant heat to the roller 120 to cause the roller 120 to heat up. The heater 110 is disposed inside the roller 120 along the axis of rotation of the roller 120.

The roller 120 has a shape of a long tube with its length (axis of rotation) oriented parallel to the width direction, and is heated by the heater 110. The roller 120 comprises a tube blank 121 made of metal or the like, and an elastic layer 122 with which the tube blank 121 is covered. The elastic layer 122 is made of rubber, such as silicone rubber. The roller 120 is rotatably supported by side frames 83 (see FIG. 4) which will be described later. Driving force received from a motor (not shown) provided in the housing 2 causes the roller 120 to rotate in a counterclockwise direction of FIG. 2.

The belt 130 is a member having a shape of a long tube (i.e., endless belt), that is, a tubular member with flexibility. The belt 130, though not illustrated, comprises a base made of metal, plastic or the like, and a release layer with which an outside surface of the base is covered. The belt 130 is caused to rotate by friction with the roller 120 or the sheet S in the clockwise direction of FIG. 2 according as the roller 120 rotates. A lubricant, such as grease, is put on an inside surface 131 of the belt 130. Inside of the belt 130, the nip-forming member N, the holder 140, the stay 200, the belt guide G, and the slide sheet 150 are disposed.

In other words, the nip-forming member N, the holder 140, the stay 200, the belt guide G, and the slide sheet 150 as a whole are surrounded and covered with the belt 130.

Figure 3:
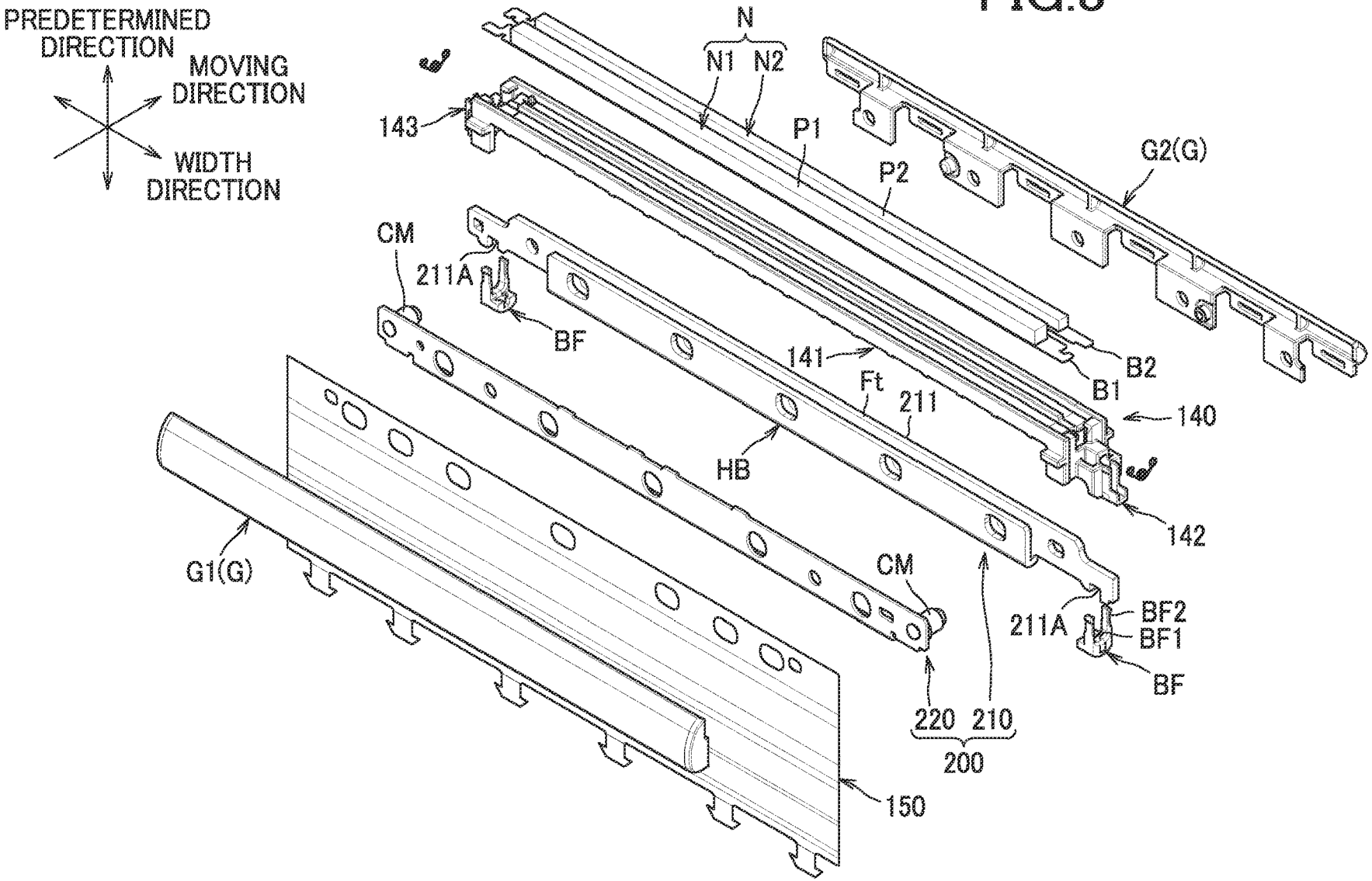
FIG. 3 is an exploded perspective view showing members arranged inside a belt.

As shown in FIG. 2 and FIG. 3, the nip-forming member N is a member comprising a pressure pad (two pads P1, P2 are provided herein), and configured to form a nip region NP in combination with the roller 120 by holding the belt 130 between the roller 120 and the pressure pad. The nip-forming member N comprises an upstream nip-forming member N1 and a downstream nip-forming member N2.

The upstream nip-forming member N1 comprises an upstream pad P1 and an upstream fastening plate B1. The upstream pad P1 is a rectangular parallelepiped member. The upstream pad P1 is made of rubber, such as silicone rubber. The upstream pad P1 and the roller 120 hold the belt 130 therebetween to form an upstream nip region NP1.

In this description, the direction of motion of the belt 130 at the upstream nip region NP1, or the nip region NP of which a detailed description will be given later, is simply referred to as "moving direction". The moving direction should in actuality vary gradually with the curved contour of the periphery (outer cylindrical surface) of the roller 120, but is herein illustrated as a direction perpendicular to the predetermined direction and to the width direction, because this direction is substantially the same direction as the direction perpendicular to the predetermined direction and to the width direction. It is to be understood that the moving direction is the same direction as a direction of conveyance of a sheet S at the nip region NP.

The upstream pad P1 is fixed to (particularly, on a roller 120 side surface of) the upstream fastening plate B1. The upstream fastening plate B1 is made of a material harder than that of the upstream pad P1. For example, the upstream fastening plate B1 may be made of metal.

The downstream nip-forming member N2 is located downstream in the moving direction of and apart from the upstream nip-forming member N1. The downstream nip-forming member N2 comprises a downstream pad P2 and a downstream fastening plate B2. The downstream pad P2 is a rectangular parallelepiped member. The downstream pad P2 is made of rubber, such as silicone rubber. The downstream pad P2 and the roller 120 hold the belt 130 therebetween to form a downstream nip region NP2. The downstream pad P2 is located apart from the upstream pad P2 in a direction of rotation (or the moving direction) of the belt 130.

Accordingly, between the upstream nip region NP1 and the downstream nip region NP2, there exists an intervening nip region NP3 on which no pressure is directly exerted from the second fixing member 82. In this intervening nip region NP3, the belt 130 is in contact with the roller 120, but almost no pressure is applied because there is no counterpart member which holds the belt 130 in combination with the roller 120. Therefore, when a sheet S conveyed through between the roller 120 and the belt 130 passes through the intervening nip region NP3, the sheet S is subjected to heat from the roller 120 but not subjected to pressure. In this description, the whole region from an upstream end of the upstream nip region NP1 to a downstream end of the downstream nip region NP2, i.e., the whole region in which the outside surface of the belt 130 and the roller 120 contact each other is referred to as "nip region NP". In other words, in this example, the nip region NP covers a region on which pressing forces from the upstream pad P1 and the downstream pad P2 are not exerted.

The downstream pad P2 is fixed to (particularly, on a roller 120 side surface of) the downstream fastening plate B2. The downstream fastening plate B2 is made of a material harder than that of the downstream pad P2. For example, the downstream fastening plate B2 may be made of metal.

The upstream pad P1 has a hardness greater than a hardness of the elastic layer 122 of the roller 120. The downstream pad P2 has a hardness greater than a hardness of the upstream pad P1.

The hardness herein refers to durometer hardness as specified in ISO 7619-1. The durometer hardness is a value determined from the depth of an indentation in a test piece created by the standardized indenter under specified conditions. For example, where the elastic layer 122 has a durometer hardness of 5, it is preferable that the upstream pad P1 have a durometer hardness in a range of 6 to 10, and the downstream pad P2 have a durometer hardness in a range of 70 to 90.

The upstream pad P1 of the upstream nip-forming member N1 and the downstream pad P2 of the downstream nip-forming member N2 illustrated herein serve, in combination, as the pressure pad of the second fixing member 82.

The holder 140 is a member that holds the nip-forming member N. The holder 140 is made of plastic or other material having a heat-resisting property. The holder 140 comprises a holder base 141 and two engagement portions 142, 143.

The holder base 141 is a portion that holds the nip-forming member N. The holder base 141 is mostly located within a space covered by the belt 130 so as not to protrude outward from the inside of the belt 130 in the width direction. The holder base 141 includes two end portions positioned near the open sides of the belt 130 (tubular endless belt) which open outward in the width direction. The holder base 141 is supported by the stay 200.

The engagement portions 142, 143 are provided at the end portions of the holder base 141. Each of the engagement portions 142, 143 extends from the corresponding end portion of the holder base 141 outward in the width direction. The engagement portions 142, 143 are located outside the space covered by the belt 130 (at the outsides of the open sides of the belt 130 which open outward in the width direction). The engagement portions 142, 143 are engaged with respective end portions of a first stay 210 which will be described below. Specifically, the end portions of the first stay 210 with which the engagement portions 142, 143 are engaged are positioned near the open sides, which open outward in the width direction, of the tubular endless belt 130.

The stay 200 is a member located across the holder 140 from the nip-forming member N to support the holder 140. In other words, the stay 200 and the nip-forming member N are on opposite sides of the holder 140. The stay 200 comprises a first stay 210, and a second stay 220 connected to the first stay 210 by means of a connecting member CM.

The first stay 210 is a member that supports the holder base 141 of the holder 140. The first stay 210 is made of metal or the like. The first stay 210 comprises a base portion 211, and a hemmed portion HB formed by bending the material back on itself.

The base portion 211 has, at one side thereof facing to the holder 140, a contact surface Ft that contacts the holder base 141 of the holder 140. The contact surface Ft is a flat surface perpendicular to the predetermined direction.

The base portion 211 having its length oriented parallel to the width direction comprises, at its both end portions, load-receiving portions 211A that receive forces from the variable pressure control mechanism 300 (see FIG. 4) which will be described later. The load-receiving portion 211A provided at each end portion of the base portion 211 is configured to have a recess that opens on a side facing away from the nip-forming member N in a direction parallel to the predetermined direction. In other words, each end portion of the base portion 211 has a side facing away from the nip-forming number N in the direction parallel to the predetermined direction, and the load-receiving portion 211A is formed at that side of each end portion of the base portion 211.

A buffer member BF made of plastic or the like is attached to the load-receiving portion 211A. The buffer member BF is a member which protects the base portion 211 made of metal and an arm 310 (see FIG. 4) which will be described later from rubbing against each other. The buffer member BF comprises a fit-on portion BF1 and a pair of leg portions BF2. The fit-on portion BF1 is configured to fit on the load-receiving portion 211A. The leg portions BF2 are located at upstream and downstream sides in the moving direction, respectively, of each of the aforementioned end portions of the base portion 211.

The belt guide G is a member that contacts the inside surface 131 to guide the belt 130. The belt guide G is made of plastic or other material having a heat-resisting property. The belt guide G comprises an upstream guide G1 and a downstream guide G2.

The slide sheet 150 is a rectangular sheet configured to reduce the frictional resistance between each pad P1, P2 and the belt 130. The slide sheet 150 is held at the nip region NP between the inside surface 131 of the belt 130 and each pad P1, P2. The slide sheet 150 is made of an elastically deformable material. It is to be understood that any material can be used for the slide sheet 150; herein, a sheet of plastic containing polyimide resin is adopted.

As shown in FIG. 2, the upstream guide G1, the downstream guide G2, and the first stay 210 are fastened together using a screw SC.

Figure 4A:
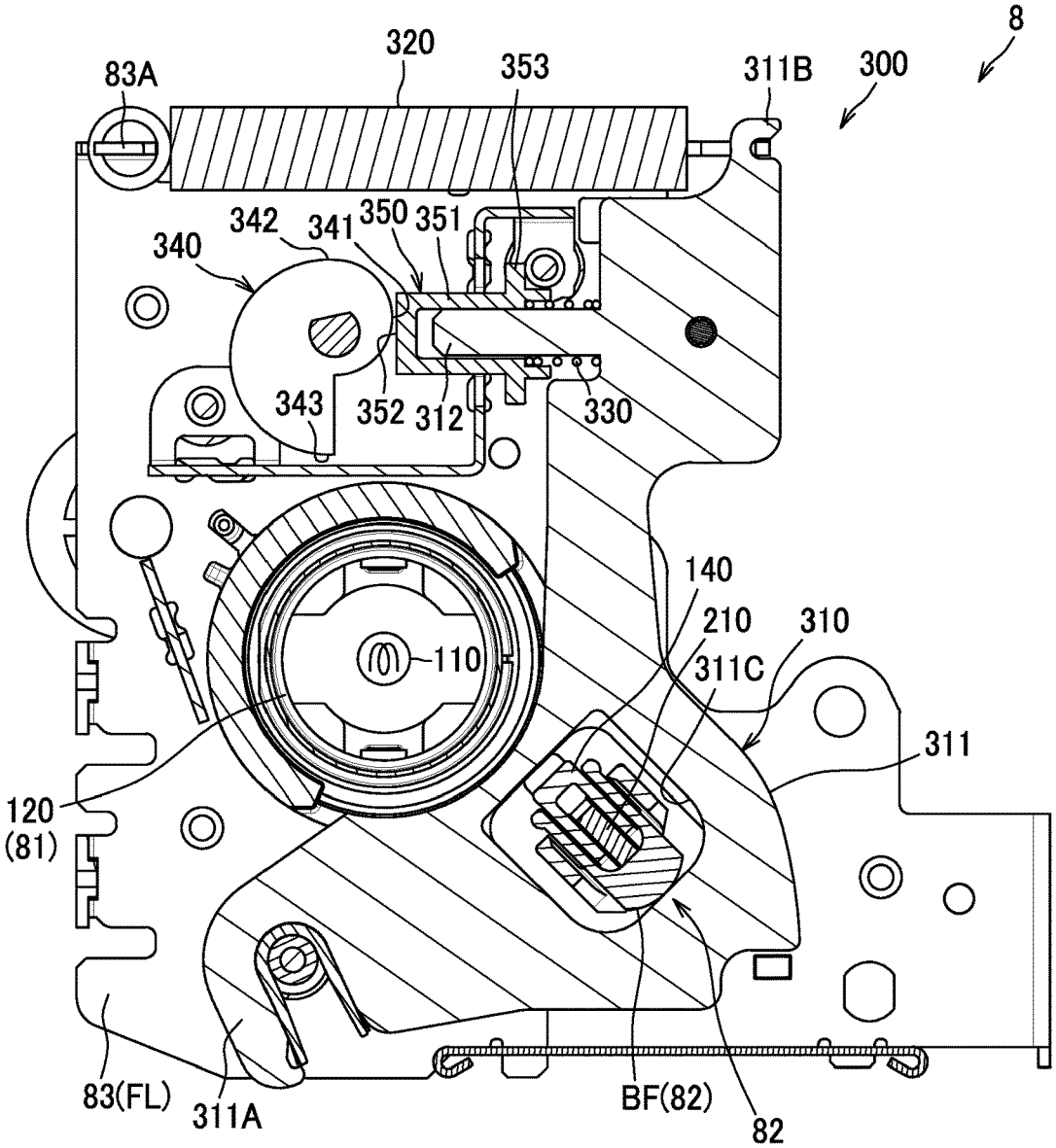
FIG. 4A is a section view of the variable pressure control mechanism in which a nip pressure is adjusted to a first pressure.
Figure 4B:
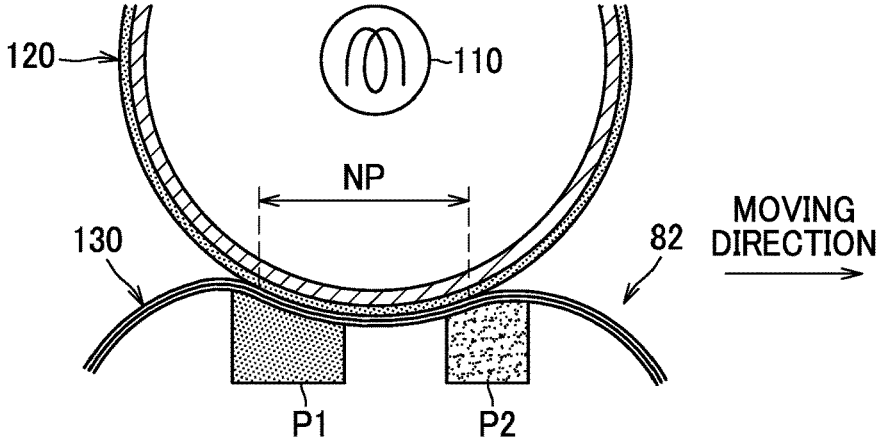
FIG. 4B is a section view showing a nip region, with its surrounding structural features, formed when the nip pressure takes on the first pressure.

As shown in FIG. 4A, the fixing device 8 further comprises a frame FL and a variable pressure control mechanism 300. The frame FL is a frame that supports the first fixing member 81 and the second fixing member 82. The frame FL is made of metal, or the like. The frame FL comprises side frames 83, and a connecting frame (not shown). The side frames 83 are provided at both sides of the first fixing member 81 and the second fixing member 82 facing outward in the width direction. The connecting frame is connected to the side frames 83.

The side frames 83 are frames that support the first fixing member 81 and the second fixing member 82. To be more specific, the roller 120 is rotatably supported by the side frames 83, and the second fixing member 82 is supported movably along the predetermined direction by the side frames 83. Each of the side frames 83 comprises a spring engageable portion 83A configured to be engageable with one end portion of a first spring 320 which will be described later.

The variable pressure control mechanism 300 is a mechanism configured to change a nip pressure exerted at the nip region NP. The variable pressure control mechanism 300 comprises an arm 310, a first spring 320 as an example of a spring, a second spring 330, and a cam 340. The arm 310, the first spring 320, the second spring 330, and the cam 340 are provided at each of the ends of the frame FL facing outward in the width direction.

The arm 310 is a member configured to push the first stay 210 with the buffer member BF interposed between the arm 310 and the first stay 210. In actuality, the arm 310 pushes the buffer member BF which in turn pushes the first stay 210. Two arms 310 are configured to support the second fixing member 82, and are rotatably supported by the side frames 83.

The arm 310 comprises an arm body 311 and a cam follower 350. The arm body 311 is an L-shaped plate member made of metal or the like.

The arm body 311 comprises a first end portion 311A rotatably supported by the side frame 83, a second end portion 311B to which the first spring 320 is connected, and an engageable hole 311C in which the second fixing member 82 is supported. The engageable hole 311C is located between the first end portion 311A and the second end portion 311B, and is engaged with the buffer member BF.

The arm body 311 further comprises a guide protrusion 312 extending long toward the cam 340. The guide protrusion 312 is located closer to the second end portion 311B than to the first end portion 311A. More specifically, the guide protrusion 312 is located closer, than the engageable hole 311C, to the second end portion 311B. That is, the guide protrusion 312 is located between a first plane intersecting the second end portion 311B and a second plane intersecting the engageable hole 311C which planes are perpendicular to a straight line passing through the second end portion 311B and the engageable hole 311C.

The cam follower 350 is fitted on the guide protrusion 312 of the arm body 311 in a manner that permits the cam follower 350 to move relative to the guide protrusion 312. The cam follower 350 is contactable with the cam 340. The cam follower 350 is made of plastic or the like, and comprises a sleeve 351, a contact portion 352, and a flange portion 353. The sleeve 351 is a portion fitted on the guide protrusion 312. The contact portion 352 is provided at one end of the sleeve 351. The flange portion 353 is provided at the other end of the sleeve 351.

The sleeve 351 is supported, by the guide protrusion 312, movably along a line parallel to the protruding direction of the guide protrusion 312. The contact portion 352 is a wall closing a cam 340 side open end of the sleeve 351, and is located between the cam 340 and the extreme end of the guide protrusion 312. The flange portion 353 protrudes from the other end of the sleeve 351 in radial directions perpendicular to a direction of movement of the cam follower 350.

A second spring 330 is disposed between the sleeve 351 and the arm body 311. Accordingly, the arm body 311 is configured not only to be biased by the first spring 320 but also to be able to be biased by the second spring 330.

The first spring 320 is a spring exerting a first biasing force (tensile force) on the second fixing member 82. Specifically, the first spring 320 exerts the first biasing force on the arm body 311 which in turn exerts the same first biasing force on the second fixing member 82; i.e., the first biasing force exerted on the arm body 311 acts via the arm body 311 on the second fixing member 82. Thus, the first spring 320 is configured to bias the second fixing member 82 toward the first fixing member 81.

To be more specific, the biasing force of the first spring 320 is transmitted via the arm body 311, the buffer member BF, the first stay 210, and the holder 140, to thereby cause the upstream pad P1 and the downstream pad P2 to be biased toward the roller 120. The first spring 320 is a helical tension spring made of metal or the like, and has its one end connected to the spring engageable portion 83A of the side frame 83, and its other end connected to the second end portion 311B of the arm body 311.

The second spring 330 is a spring capable of exerting, on the second fixing member 82, a second biasing force (compression-resisting force) in a direction opposite to a direction of the first biasing force. Specifically, the second spring 330 is configured to be capable of exerting the second biasing force on the arm body 311 which in turn exerts the same second biasing force on the second fixing member 82; i.e., the second biasing force exerted on the arm body 311 acts via the arm body 311 on the second fixing member 82. The second spring 330 is a helical compression spring made of metal or the like, and is disposed between the sleeve 351 and the arm body 311 with the guide protrusion 312 inserted in a space surrounded by the helical compression spring.

The cam 340 is a member which causes the second fixing member 82 to move against the biasing force of the first spring 320. The cam 340 is configured to be capable of changing the compression state of the second spring 330 to a first compression state in which the second biasing force is not exerted on the second fixing member 82, to a second compression state in which the second biasing force is exerted on the second fixing member 82, and to a third compression state in which the second spring 330 is deformed more than in the second compression state. The cam 340 is supported by the side frame 83 in a manner that allows the cam 340 to rotate to a first cam position shown in FIG. 4A, to an intermediate cam position (not shown) that is a position displaced from the first cam position approximately 90 degrees in the clockwise direction as in the drawing, and to a second cam position (not shown) that is a position displaced from the intermediate cam position approximately 180 degrees in the clockwise direction as in the drawing.

The cam 340 is made of plastic or the like, and comprises a first region 341, a second region 342, and a third region 343. The first region 341, the second region 342, and the third region 343 are located on an outer surface (periphery) of the cam 340.

The first region 341 is a region that comes closest to the cam follower 350 when the cam 340 is in the first cam position. When the cam 340 is in the first cam position, the first region 341 is located apart from the cam follower 350.

The second region 342 is a region that contacts the cam follower 350 when the cam 340 is in the intermediate cam position. To be more specific, the second region 342 comes in contact with the cam follower 350 when the cam 340 is caused to rotate from the first cam position approximately 90 degrees in the clockwise direction as in the drawing. The distance from the second region 342 to the center of rotation of the cam 340 is greater than the distances from the first region 341 to the center of rotation of the cam 340.

The third region 343 is a region that contacts the cam follower 350 when the cam 340 is in the second cam position. To be more specific, the third region 343 comes in contact with cam follower 350 when the cam 340 is caused to rotate from the first cam position approximately 270 degrees in the clockwise direction as in the drawing, in other words, when caused to rotate from the intermediate cam position approximately 180 degrees in the clockwise direction as in the drawing. The distance from the third region 343 to the center of rotation of the cam 340 is greater than the distance from the second region 342 to the center of rotation of the cam 340.

When the cam 340 is in the first cam position, the cam 340 is positioned apart from the cam follower 350, and thus the second spring 330 is in the first compression state. In this state, where the cam 340 leaves the second spring 330 in the first compression state, the arm body 311 assumes the first position shown in FIG. 4A.

To be more specific, when the cam 340 leaves the second spring 330 in the first compression state, the second biasing force of the second spring 330 is not exerted via the arm body 311 on the second fixing member 82 because the cam 340 is positioned apart from the cam follower 350, so that only the first biasing force of the first spring 320 is exerted via the arm body 311 on the second fixing member 82. In this state where the first biasing force is exerted on the second fixing member 82 by the first spring 320 and the second biasing force is not exerted on the second fixing member 82 by the second spring 330, the nip pressure takes on the first pressure, that is, the maximum nip pressure.

The cam 340 when caused to rotate from the first cam positon to the intermediate cam position comes in contact with the cam follower 350 and causes the cam follower 350 to move for a predetermined distance relative to the arm body 311. When the cam 340 thus gets positioned in the intermediate cam position, the compression state of the second spring 33 changes to the second compression state in which the second spring 330 is deformed (compressed) more than in the first compression state.

When the cam 340 is positioned in the intermediate cam position, the cam follower 350 is supported by the cam 340, so that the second biasing force of the second spring 330 is exerted via the arm body 311 on the second fixing member 82 in a direction reverse to the direction of the first biasing force. Therefore, where the first biasing force is exerted on the second fixing member 82 by the first spring 320 and the second biasing force is exerted on the second fixing member 82 by the second spring 330, the nip pressure takes on the intermediate pressure smaller than the first pressure.

When the cam 340 causes the second spring 330 to assume the second compression state, the arm body 311 remains in the first position described above. It is to be understood that the downstream pad P2 is substantially not deformed when pressed against the roller 120, i.e., put under a load irrespective of its magnitude. As the downstream pad P2 is substantially not deformed, the positions of the stay 200 supporting the downstream pad P2, and the arm 310 supporting the stay 200 as well, remain substantially unchanged irrespective of the magnitude of the load. Moreover, the position of the upstream pad P1 depends on the position of the downstream pad P2, and thus remains unchanged, if the downstream pad P2 is substantially not deformed with its position unchanged accordingly. Therefore, the strong nip condition (under the first pressure) and the weak nip condition (under the intermediate pressure) are not different from each other in terms of the entire nip width (distance from an entrance or upstream edge of the upstream nip region NP1 to an exit or downstream edge of the downstream nip region NP2), and the position of the arm 310 remains substantially unchanged between these nip conditions.

The reason that the downstream pad P2 is not deformed is that the hardness of the downstream pad P2 is sufficiently greater than the hardness of the upstream pad P1 and the hardness of the elastic layer 122 of the roller 120. To be more specific, the reason lies in that the downstream pad P2 is hard enough to resist nonnegligible deformation which would otherwise be caused by a required range of nip pressures from the maximum nip pressure (downstream nip pressure under the strong nip condition) to the minimum nip pressure (downstream nip pressure under the weak nip condition) to be produced at the downstream nip region NP2.

Conversely, the maximum nip pressure and the minimum nip pressure required to be produced at the downstream nip region NP2 are set at such levels that the downstream pad P2 is substantially not deformed.

Hereupon, it is to be understood that "the downstream nip P2 is substantially not deformed" connotes that the downstream nip P2 may be deformed to such a level that change in the nip width (dimension and position of the nip in the moving direction of the belt) of the downstream nip region NP2 formed by the downstream pad P2 would not affect the image quality and the sheet conveyance (i.e., the variation in the downstream nip width may not be zero).

Since the arm body 311 assumes the first position regardless of whether the second spring 330 is in the first compression state or in the second compression state as described above, both of the upstream pad P1 and the downstream pad P2 serve to hold the belt 130 so that the belt 130 is held between the upstream pad P1 and the roller 120 and between the downstream pad P2 and the roller 120, under the both nip conditions: the condition in which the nip pressure takes on the first pressure; and the condition in which the nip pressure takes on the intermediate pressure. More specifically, the position of the second fixing member 82 relative to the roller 120 is substantially the same under the both conditions, and thus the width (dimension in the moving direction) of the nip region NP is substantially the same under the both conditions.

The first pressure and the intermediate pressure refer to the set values predetermined as nip pressures to be applied when the process of printing, particularly fixing a toner image on a sheet S, is performed. For example, the nip pressure is set at the first pressure when a sheet to be subjected to the fixing process has a first thickness, and at the intermediate pressure when a thicker sheet having a second thickness greater than the first thickness is to be subjected to the fixing process.

When the cam 340 rotates from the intermediate cam position to the second cam position, the cam 340 causes the cam follower 350 to move relative to the arm body 311, and then pushes the arm body 311 via the cam follower 350. Accordingly, the compression state of the second spring 330 changes to the third compression state in which the second spring 330 is deformed more than in the second compression state, and the arm body 311 is caused to rotate from the first position to the second position different from the first position.

To be more specific, in the first stage of the process of rotation of the cam 340 from the intermediate cam position to the second cam position, the cam follower 350 moves relative to the arm body 311, and the contact portion 352 of the cam follower 350 approaches the extreme end of the guide protrusion 312. When the contact portion 352 comes in contact with the extreme end of the guide protrusion 312, the compression state of the second spring 330 changes to the third compression state. Accordingly, when the cam 340 causes the second spring 330 to assume the third compression state, the contact portion 352 that is part of the cam follower 350 is held between the cam 340 and the guide protrusion 312. In other words, the contact portion 352 not only contacts the cam 340 but also contacts the guide protrusion 312. Thereafter, the cam 340 further caused to rotate pushes the guide protrusion 312 via the contact portion 352, and the arm body 311 is thereby caused to rotate against the biasing force of the first spring 320 from the first position to the second position.

In this way, when the arm body 311 is in the second position, the second fixing member 82 is located in a position farther apart from the roller 120 than a position (see FIG. 4B) in which the second fixing member 82 is located when the arm body 311 is in the first position. In the following description, the position of the second fixing member 82 located when the arm body 311 is in the first position is also referred to as "nip position", and the position of the second fixing member 82 located when the arm body 311 is in the second position is also referred to as "nip release position".

Such change in the position of the second fixing member 82 relative to the roller 120 makes the width (dimension in the moving direction) of the nip region NP formed when the arm body 311 is in the second position smaller than that formed when the arm body 311 is in the first position, and the nip pressure is changed to the second pressure smaller than the intermediate pressure, that is, the minimum nip pressure. In other words, the position of the arm 310 is changed by the cam 340 whereby the nip pressure and the nip width are changed. To be more specific, when the arm 310 is in the second position, the belt 130 is held only between the upstream pad P1 and the roller 120 but not held between the downstream pad P2 and the roller 120. Therefore, when the arm 310 is in the second position, the upstream nip pressure and the upstream nip width become smaller, and the downstream nip pressure becomes zero.

The second pressure refers to the set value predetermined as a nip pressure to be applied when the process of printing is not performed or the motor (not shown) for providing a driving force to the fixing device 8 is stopped.

In the illustrated example, when the nip pressure takes on the second pressure, the upstream pad P1 serves to hold the belt 130, and the belt 130 is held between the upstream pad P1 and the roller 120; however, this configuration may not be essential for this implementation. As an alternative, the belt 130 may not be held between the upstream pad P1 and the roller 120 when the nip pressure takes on the second pressure. In this alternative example, the second nip pressure is zero.

Figure 5:
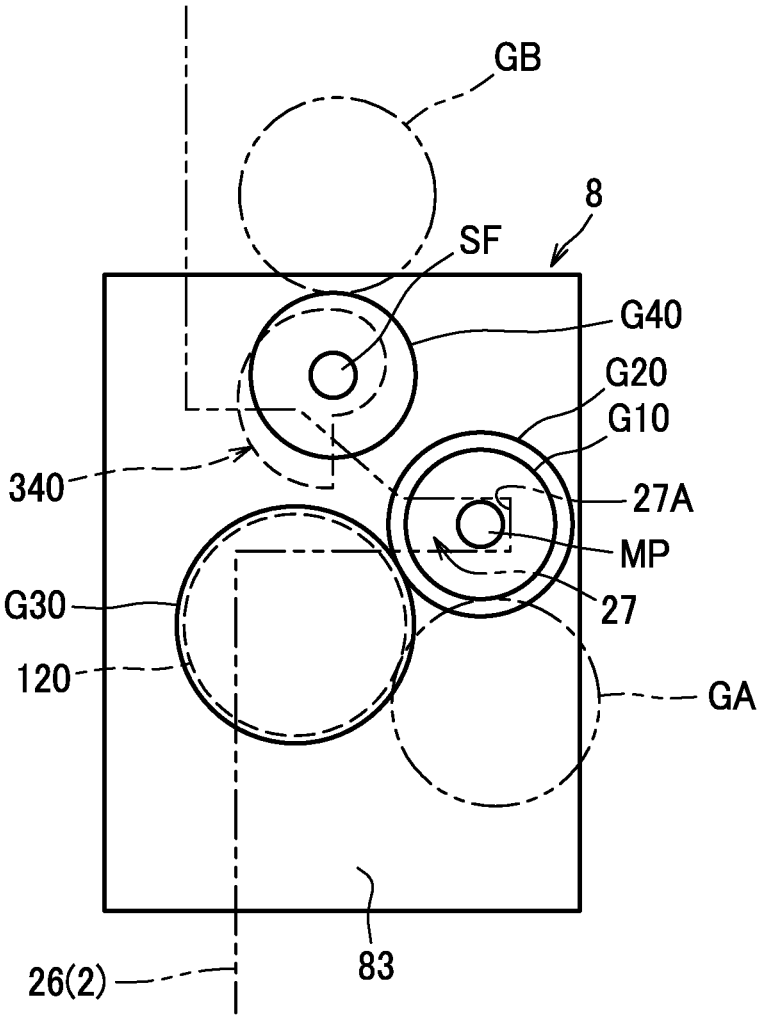
FIG. 5 shows a gear provided in the fixing device, and a frame of a housing of the image forming apparatus.

As shown in FIG. 5, the fixing device 8 further comprises a first gear G10, a second gear G20, a third gear G30, a cam gear G40, and a metal shaft MP. The housing 2 comprises a body frame 26, a main gear GA, and a cam drive gear GB. The main gear GA serves to transmit a driving force to the roller 120 of the fixing device 8. The cam drive gear GB serves to transmit a driving force to the cam 340 of the fixing device 8.

The first gear G10, the second gear G20 and the third gear G30 are made of plastic. The materials of the first gear G10, the second gear G20 and the third gear G30 are different from one another. Specifically, the first gear G10 and the second gear G20 are made of crystallized polymer. To be more specific, the material of the second gear G20 has a melting point higher than a melting point of the material of the first gear G10, and has a glass transition temperature higher than a glass transition temperature of the material of the first gear G10. The second gear G20 has a hardness greater than a hardness of the first gear G10. The third gear G30 has a hardness equal to or greater than the hardness of the second gear G20. The main gear GA has a hardness equal to or greater than the hardness of the first gear G10.

More specifically, the first gear G10 and the main gear GA are made, for example, of polyoxymethylene (POM). The second gear G20 is made, for example, of polybutylene terephthalate (PBT). The third gear G30 is made, for example, of polyphenylene sulfide (PPS).

The first gear G10, the second gear G20, the third gear G30, and the cam gear G40 are located at an outer surface of the side frame 83. The first gear G10 is a gear configured to receive a driving force from the main gear GA. The first gear G10 meshes with the main gear GA when the fixing device 8 is installed in the housing 2.

The second gear G20 is configured to rotate together with the first gear G10 about a center of rotation of the first gear G10. The second gear G20 meshes with the third gear G30.

The third gear G30 is disposed on an outer periphery of the roller 120 and configured to rotate together with the roller 120. The third gear G30 is provided integrally with the roller 120 at an end of the roller 120 facing outward in the width direction.

The cam gear G40 is configured to rotate together with the cam 340. The cam gear G40 and the cam 340 are connected by a shaft SF, and rotate together about the shaft SF. The cam gear G40 meshes with the cam drive gear GB when the fixing device 8 is installed in the housing 2.

The metal shaft MP is supported by the side frame 83. To be more specific, the metal shaft MP is staked, riveted or otherwise fixed to the metal side frame 83 (see FIG. 8). The first gear G10 and the second gear G20 are rotatably supported by the metal shaft MP.

The body frame 26 has a positioning slot 27 for use in locating the fixing device 8. The metal shaft MP of the fixing device 8 serves as a positioning protrusion engageable in the positioning slot 27. The respective members are arranged and configured such that a projection of the metal shaft MP in a direction of a vector PW of a force to be exerted from the main gear GA on the first gear G10 (see the direction PW of load in FIG. 10A) overlaps a bottom 27A of the positioning slot 27. The projection of the metal shaft MP is indicated by lines X in FIG. 10B. To be more specific, the direction of the depth of the positioning slot 27 and the positions of the first gear G10 and the metal shaft PM are configured such that the parallel projections of the metal shaft MP and the bottom 27A overlap each other on an image plane.

It is to be understood that the direction of the vector PW of the force to be exerted from the main gear on the first gear G10 is determined by a pressure angle of the main gear GA.

The main gear GA and the cam drive gear GB are configured to receive a driving force from a motor (not shown) provided in the housing 2. The main gear GA and the cam drive gear GB may be driven by a common motor or different motors provided in the housing 2.

The cam drive gear GB is located across the cam gear G40 from the third gear G30, in other words, the cam drive gear GB and the third gear G30 are located on opposite sides of the cam gear G40, when the fixing device 8 is installed in the housing 2.

Figure 6:
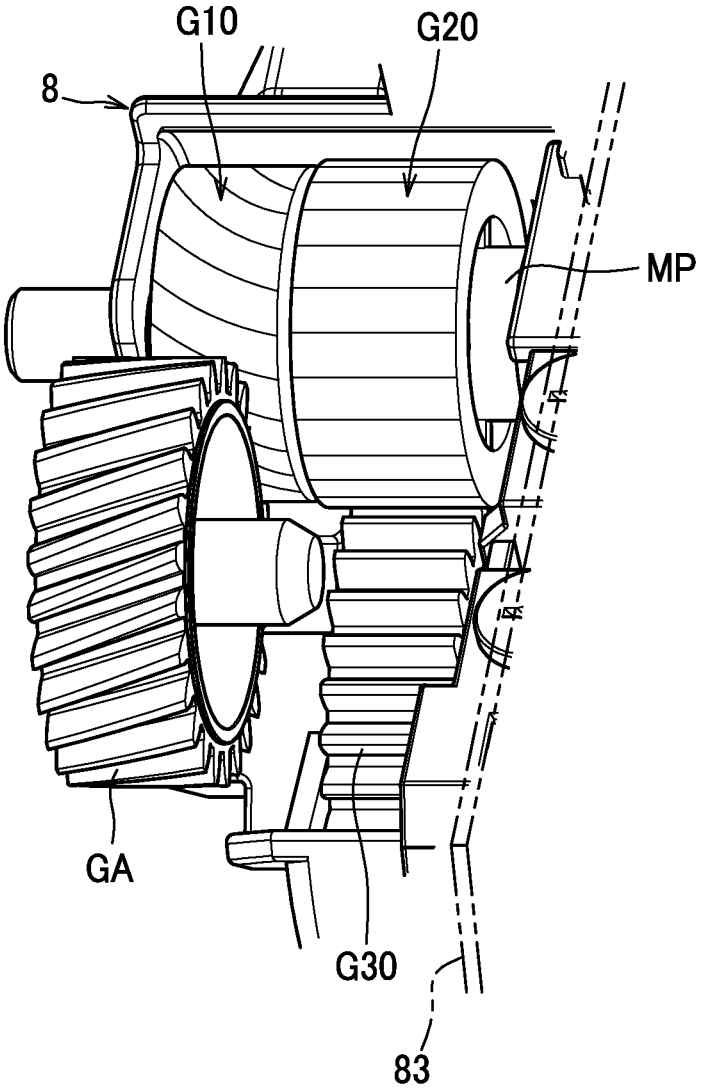
FIG. 6 is a perspective view showing a first gear and a second gear with their surrounding structural features.

As shown in FIG. 6, the first gear G10 and the second gear G20 are arranged along an axis of the metal shaft MP. The second gear G20 (specifically, a main portion G21 thereof which will be described later) is located between the side frame 83 and the first gear G10; thus, the first gear G10, the second gear G20 and the side frame 83 are arranged along the axial direction (see also FIG. 8).

Each of the main gear GA and the first gear G10 is configured as a helical gear. Each of the second gear G20 and the third gear G30 is configured as a spur gear. The thrust force that occurs with the first gear G10 is directed toward the second gear G20.

Figure 7A:
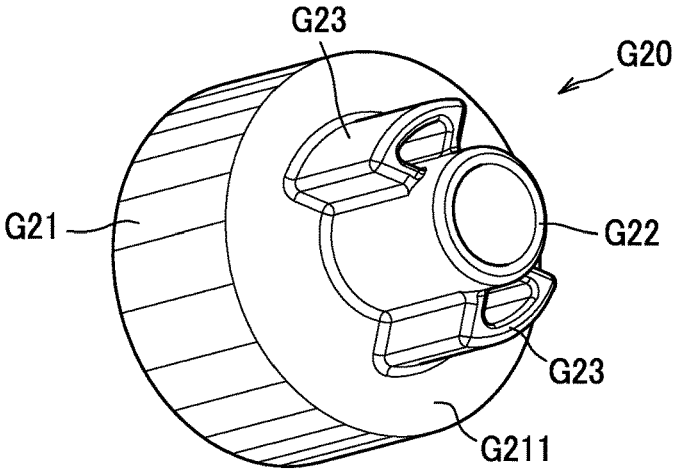
FIG. 7A is a perspective view showing the second gear.
Figure 7B:
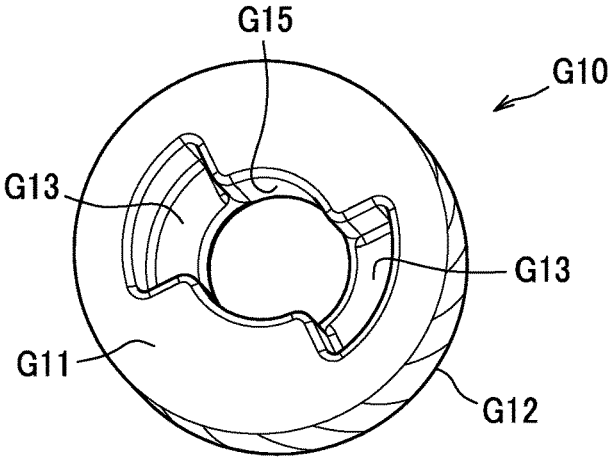
FIG. 7B is a perspective view showing the first gear.
Figure 7C:
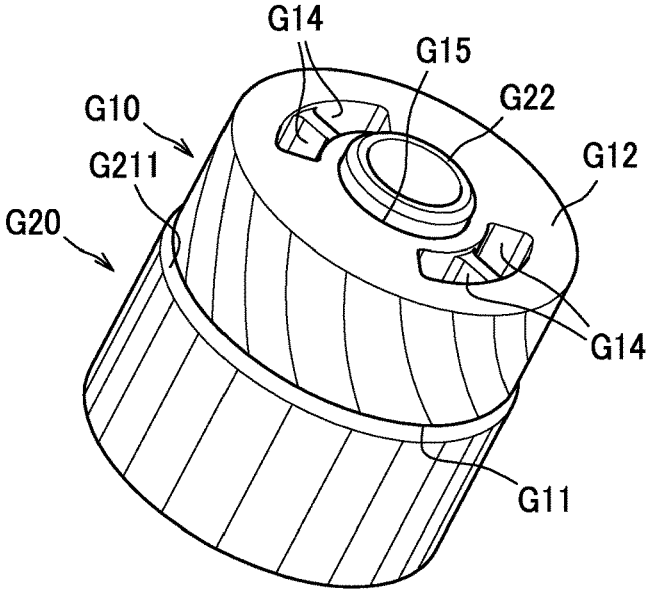
FIG. 7C is a perspective view showing the first gear and the second gear assembled together.

As shown in FIGS. 7A and 7C, the second gear G20 comprises a main portion G21, a sleeve G22, and engageable protrusions G23. The sleeve G22 and the engageable protrusions G23 protrude from the main portion G21. The main portion G21 has a shape of a disc of which an outer cylindrical surface has gear teeth formed thereon. The main portion G21 has an outer surface G211 as an example of a first surface that faces the first gear G10. The main portion G21 has a hole G212 for the metal shaft MP to be inserted therethrough (see FIG. 8).

Figure 8:
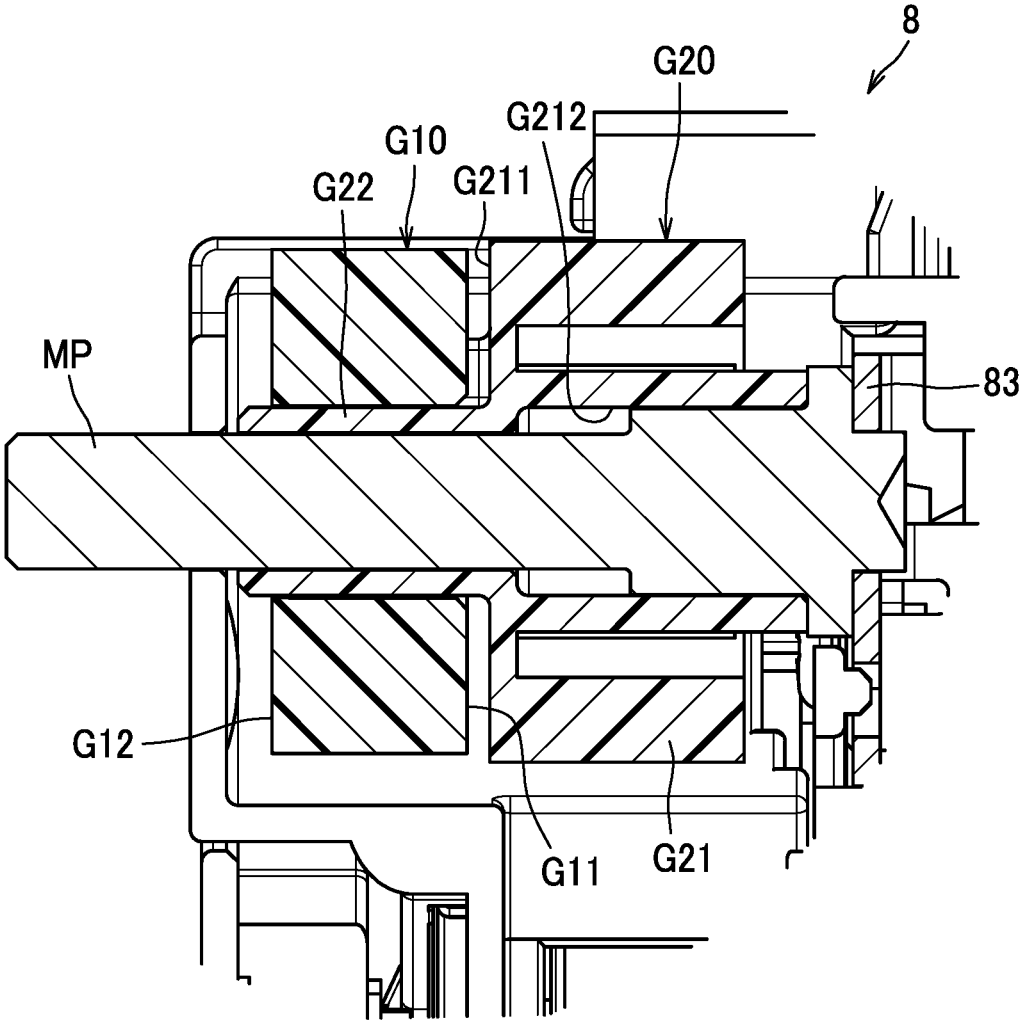
FIG. 8 is a section view showing the first gear and the second gear with their surrounding structural features.

The sleeve G22 and the engageable protrusions G23 protrude from the outer surface G211 of the main portion G21. The sleeve G22 is a portion having a shape of a hollow circular cylinder of which an axis coincides with an axis of rotation of the second gear G20. The inside of the sleeve G22 is configured to allow the metal shaft MP to be located therethrough. As shown in FIG. 8, the sleeve G22 is provided around the metal shaft MP and rotatably supported by the metal shaft MP when the second gear G20 is attached to the metal shaft MP.

As shown in FIG. 7A, two engageable protrusions G23, as an example of a protrusion, are provided on diametrically opposite sides of the sleeve G22, i.e., arranged rotationally symmetric with respect to the axis of rotation of the second gear G20 along a diameter of the second gear G20 so that the sleeve G22 is located between the engageable protrusions G23. Each engageable protrusion G23 has a shape of a fan in cross section. The length of protrusion of the engageable protrusion G23 from the outer surface G211 is shorter than the length of protrusion of the sleeve G22 from the outer surface G211.

As shown in FIGS. 7B and 7C, the first gear G10 comprises an inside surface G11 as an example of a second surface, an outside surface G12 as an example of a third surface, engageable recesses G13 as an example of a first recess, radiating recesses G14 as an example of a second recess, and a through hole G15. The inside surface G11 is a surface that faces the outer surface G211 of the second gear G20. The outside surface G12 is a surface facing away from the inside surface G11, particularly, a surface opposite to the inside surface G11.

The engageable recesses G13 are recessed portions engageable with the engageable protrusions G23. The engageable recesses are formed on the inside surface G11. To be more specific, the engageable recesses G13 are recessed from the inside surface G11 toward the outside surface G12. Two engageable recesses G13 are provided on diametrically opposite sides of the through hole G15, i.e., arranged rotationally symmetric with respect to the axis of rotation of the first gear G10 along a diameter of the first gear G10 so that the through hole G15 is located between the engageable recesses G13. Each engageable recess G13 has a shape contoured to fit the corresponding engageable protrusion G23, i.e., a shape of a fan in cross section.

The depth of the engageable recess G13 is less than the height or protruding length of the engageable protrusion G23 (dimension from the outer surface G211 to the farthermost end of the engageable protrusion G23). In other words, in the direction of the axis of the first gear G10, a dimension of the engageable recess G13 is smaller than a dimension of the engageable protrusion G23. Accordingly, when the engageable protrusions G23 contact the bottoms of the engageable recesses G13, a gap is formed between the inside surface G11 of the first gear G10 and the outer surface G211 of the second gear G20 (see also FIG. 8).

The radiating recesses G14 are provided to increase the surface area of the first gear G10 to thereby improve heat dissipation from the first gear G10. The radiating recesses G14 are formed on the outside surface G12. To be more specific, the radiating recesses G14 are recessed from the outside surface G12 toward the inside surface G11. Each of the radiating recesses G14 has an arcuate shape extending along a segment of a circle of which a center coincides with the axis of rotation of the first gear G10. Four radiating recesses G14 are provided, of which two in pair are located on diametrically opposite sides of the through hole G15 respectively, i.e., arranged rotationally symmetric with respect to the axis of rotation of the first gear G10 along the diameter of the first gear G10 so that the through hole G15 is located between two pairs of the radiating recesses G14.

Figure 9A:
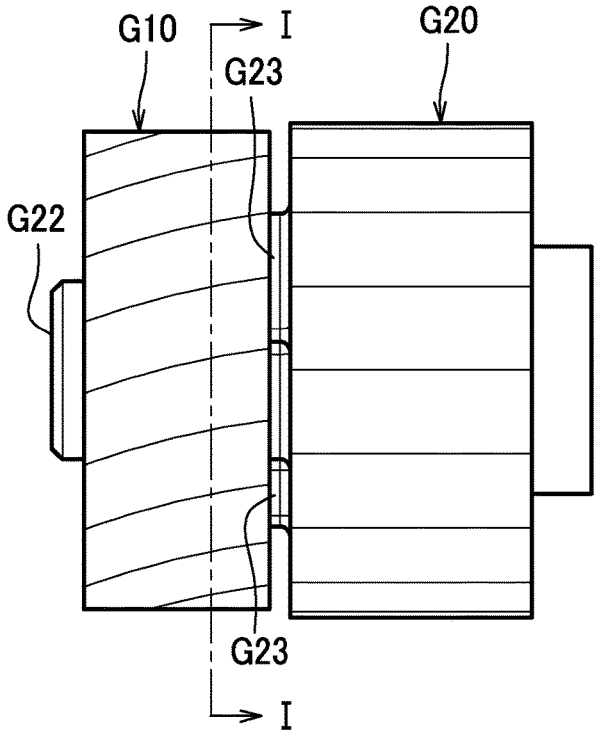
FIG. 9A is a side view showing the first gear and the second gear.
Figure 9B:
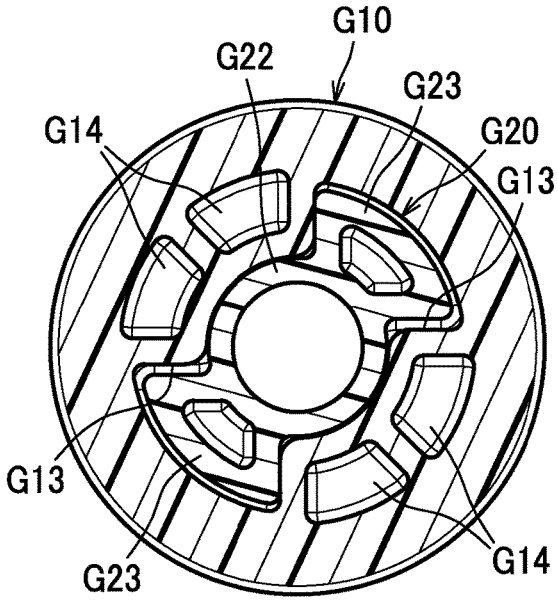
FIG. 9B is a section view taken along line I-I of FIG. 9A.

As shown in FIGS. 9A and 9B, each radiating recess G14 is provided in a position angularly displaced from a position of each engageable recess G13 about the axis of rotation of the first gear G10. To be more specific, each pair of two adjacent radiating recesses G14 is located between the two engageable recesses G13 in the circumferential direction of the first gear G10. With this configuration, each of the engageable recesses G13 and the radiating recesses G14 can be made deeper than half the thickness of the first gear G10.

As shown in FIG. 7B, the through hole G15 has a shape of a circular cylinder of which an axis coincides with the axis of rotation of the first gear G10. The through hole G15 is located in the center of the inside surface G11 and in the center of the outside surface G12, so that the through hole G15 connects the inside surface G11 and the outside surface G12 of the first gear G10 and extends in the direction of axis of rotation of the first gear G10. As shown in FIG. 7C, the sleeve G22 of the second gear G20 is inserted in the through hole G15. When the engageable protrusions G23 are in contact with the bottoms of the engageable recesses G13, the sleeve G22 protrudes from the outside surface G12 of the first gear G10.

With the first gear G10 and the second gear G20 configured as described above, as shown in FIG. 8, the first gear G10 is supported via the sleeve G22 of the second gear G20 by the metal shaft MP. It is to be noted that the melting point of the material of the sleeve G22 provided integrally with the second gear G20 is higher than the melting point of the material of the first gear G10. Therefore, transfer of heat of the metal shaft MP to the first gear G10 is restrained by the sleeve G22 which is more resistant to melting with heat.

In the illustrative, non-limiting embodiment described above, the following advantageous effects can be achieved.

Figure 10A:
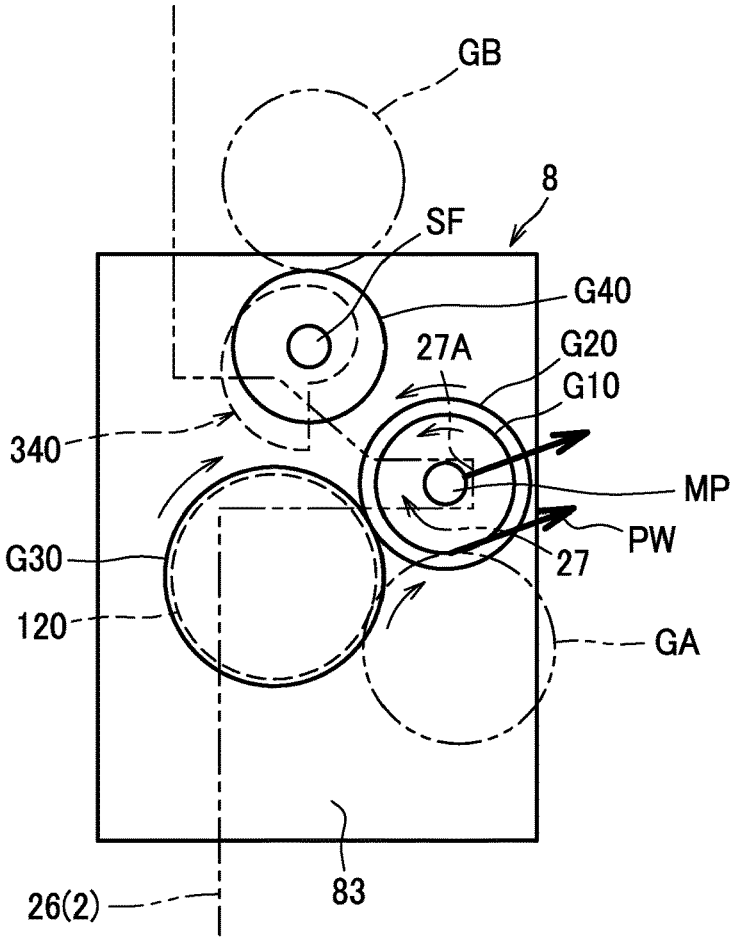
FIG. 10A shows a direction of a force (load) exerted from the main gear on the first gear.
Figure 10B:
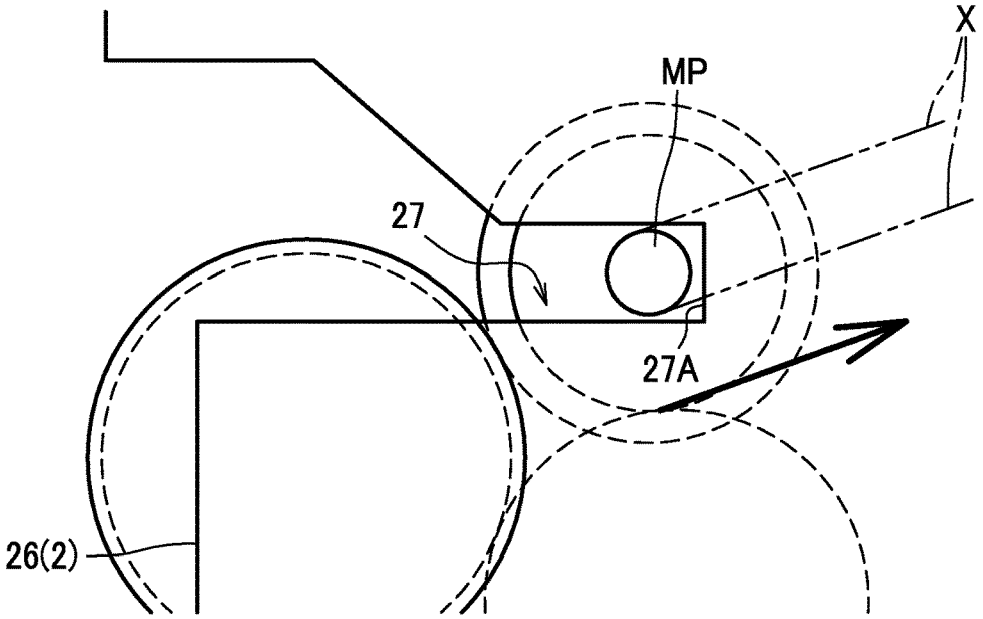
FIG. 10B shows a projection of a metal shaft in the direction of the load exerted from the main gear on the first gear.

As shown in FIG. 10A, when a driving force is transmitted from the motor (not shown) to the main gear GA, the main gear GA is caused to rotate in the clockwise direction as in the drawing, and a force is exerted from the main gear GA on the first gear G10 in the direction PW of the load that is an obliquely-rightward-and-upward direction in the drawing. Therefore, the metal shaft MP is pressed against the bottom 27A of the positioning slot 27 of the housing 2, so that undesirable displacement of the fixing device 8 during operation of the fixing device 8 can be restrained.

When the fixing device 8 is in operation, as shown in FIG. 8, heat in the fixing unit 8 is transferred via the side frame 83 to the metal shaft MP. Supposing that the first gear G10 of a material having a lower melting point is supported directly by the metal shaft MP, heat transferred through the metal shaft MP to the first gear G10 would possibly cause the first gear G1 to melt. In contrast, in the fixing device 8 configured as described above, where the first gear G10 is supported by the metal shaft MP via the sleeve G22 of a material having a higher melting point and thus more resistant to melting with heat, transfer of heat through the metal shaft MP to the first gear G10 is restricted by the intervening sleeve G22, so that disadvantageous melting of the first gear G10 due to heat transferred from the metal shaft MP can be restrained.

Since the main portion G21 of the second gear G20 of a material having a higher melting point is located between the side frame 83 and the first gear G10, transfer of heat from the side frame 83 to the first gear G10 can be obstructed by the main portion G21.

Since the radiating recesses G14 and the engageable recesses G13 are located in positions angularly displaced from each other, the depths of the radiating recesses G14 and the engageable recesses G13 can be increased.

Since the height of the engageable protrusion G23 (dimension from the outer surface G211 to the farthermost end of the engageable protrusion G23) is greater than the depth of the engageable recess G13, a gap is formed between the first gear G10 and the main portion G21 of the second gear G20 when the engageable protrusion G23 is engaged with the engageable recess G13, so that the main gear GA in mesh with the first gear G10 can be restrained from interfering with the second gear G20. Furthermore, arrangement of the gap between the first gear G10 and the main portion G21 of the second gear G20 serves to increase exposed-to-air portions of the surface areas of the first gear G10 and the second gear G20, so that the heat dissipating properties of the first and second gears G10, G20 can be improved.

Since the second gear G20 comprises the sleeve G22, the number of parts can be reduced in comparison, for example, with an alternative configuration in which the second gear and the sleeve are provided individually.

Since the first gear G10 and the main gear GA are configured as helical gears, the gear teeth engage gradually and tooth bearing are shared by more than one tooth pair at a time, so that improved quietness can be achieved.

Since the second gear G20 and the third gear G30 are configured as spur gears, thrust bearing imposed from the second gear G20 on the third gear G30 can be restrained, so that undesirable shift of the roller 120 along the axial direction can be restricted.

Since the projection of the metal shaft MP engaged in the positioning slot 27 in the direction of the vector PW of load overlaps the bottom 27A of the positioning slot 27, the force exerted from the main gear GA on the first gear G10 during operation of the fixing device 8 causes the metal shaft MP to be pressed against the bottom 27A of the positioning slot 27, so that undesirable shift of the position of the fixing device 8 which would be caused during operation of the fixing device 8 can be restricted.

Since the metal shaft MP used to support the first gear G10 and the second gear G20 also serves as a positioning protrusion engageable in the positioning slot 27, the cost of manufacturing the fixing device 8 can be saved in comparison with an alternative configuration in which a dedicated positioning protrusion is provided independently of the metal shaft.

Since the cam drive gear GB is located across the cam gear G40 from the third gear G30, heat received by the third gear G30 from the roller 120 can be restrained from being transferred to the cam drive gear GB.

Since the hardness of the main gear GA is equal to or greater than the hardness of the first gear G10, undesirable wear of the main gear GA can be restricted, so that the service life of the housing 2 can be extended.

The above-described embodiment may be implemented in various other forms as described below.

The illustrated configuration for the first spring 320 to bias the second fixing member 82 toward the first fixing member 81 may not be essential. Alternatively, the first spring may be arranged to bias the first fixing member toward the second fixing member. In this alternative configuration, the cam may be configured to cause the first fixing member to move against the biasing force of the first spring.

In other words, one of the first fixing member and the second fixing member may comprise a movable member, and the other of the first fixing member and the second fixing member may comprise a stationary member, such that the movable member is configured to be movable relative to the stationary member, and the first spring may be arranged to bias the movable member toward the stationary member, and the cam may be rotatably arranged to cause the movable member to move against the biasing force of the first spring.

The variable pressure control mechanism 300 comprising the first spring 320 and the second spring 330 are described above, but the second spring 330 may not be provided in the variable pressure control mechanism. In this alternative configuration, the cam follower 350 may also be omitted, and the cam 340 may be configured to push the arm body 311 directly. Moreover, a spring directly biasing the movable member (i.e., one of the first fixing member and the second fixing member) toward the stationary member (i.e., the other of the first fixing member and the second fixing member) without using an arm or other intervening member may also be adoptable.

The image forming apparatus may not be a laser printer, and may be a printer with an LED-type exposure device, a copier, a multifunction machine, or the like.

The sleeve G22 and the second gear G20 formed integrally in one piece as illustrated in the above-described embodiment may be modified into two separate members; that is, the sleeve may be a portion provided separately from the second gear, and the second gear may be supported via the sleeve by the metal shaft.

The engageable protrusions G23 provided in the second gear G20 and the engageable recesses G13 provided in the first gear G10 as illustrated in the above-described embodiment may be modified with the protrusions and the recesses interchanged between the gears; that is, the engageable protrusions may be provided in the first gear and the engageable recesses may be provided in the second gear. A further alternative configuration may be feasible such that a first engageable protrusion and a first engageable recess are provided in the first gear and a second engageable recess engageable with the first engageable protrusion and a second engageable protrusion engageable with the first engageable recess are provided in the second gear.

The first spring and the second spring may not be a helical spring as described above, and a torsion spring, a leaf spring, etc. may be used, instead.

Although the fixing device 8 described above uses a heater 110, the fixing device which uses no heater may also be feasible. The fixing device may be a device configured to apply light to the nip region to thereby fix a developer image onto a sheet.

A halogen lamp illustrated as an example of a heater may be substituted, for example, by a carbon heater.

Although the upstream pad P1 and the downstream pad P2 described above are both made of rubber, the pads may be made, for example, of plastic, metal or other hard material resistant to deformation even under pressure.

The pressure pad provided in the second fixing member may not necessarily comprise two pads P1, P2, and may comprise one, or more than three pads, instead.

The support member is exemplified by the holder 140 and the stay 200 in the above description, but the support member may be made up of a holder only, or of a stay only.

Alternatively, a holder and a stay may be configured as a monolithic member.

Although the developer image forming unit is described above as comprising the photoconductor drum 61, the charger 62 and other components, the developer image forming unit may alternatively be configured to comprise a belt-type photoconductor and a charging roller. Although the first fixing member is exemplified by the tubular roller in which the heater 110 is disposed, the first fixing member may be a pressure roller comprising a shaft and a rubber layer formed around the shaft. An endless belt of which an inner side is heated by a heater may also be used, instead. An external heating scheme in which a heater is disposed outside the first fixing member to heat an outer surface of the first fixing member, or an induction heating scheme known in the art may also be adopted. Another alternative configuration in which a heater is provided in the second fixing member to indirectly heat the first fixing member in contact with the outer periphery of the second fixing member may also be feasible. Each of the first fixing member and the second fixing member may be configured to incorporate a heater. The second fixing member may also be configured as a pressure roller comprising a shaft and a rubber layer formed around the shaft.

The elements described in the above embodiment and its modified examples may be implemented selectively and in combination.

What is claimed is:

1. A fixing device comprising:

a first fixing member configured to rotate;

a second fixing member configured to form a nip in combination with the first fixing member;

a first gear configured to receive a driving force from a main gear provided in an image forming apparatus;

a second gear configured to rotate together with the first gear about a center of rotation of the first gear;

a third gear provided in mesh with the second gear and configured to rotate together with the first fixing member;

a metal shaft by which the first gear and the second gear are rotatably supported;

a side frame supporting the first fixing member and the metal shaft; and a sleeve provided around the metal shaft, wherein a material of the second gear and a material of the sleeve have melting points higher than a melting point of a material of the first gear, and wherein the first gear is supported via the sleeve by the metal shaft.

2. The fixing device according to claim 1, wherein the second gear is located between the side frame and the first gear.

3. The fixing device according to claim 1, further comprising a heater configured to heat the first fixing member.

4. The fixing device according to claim 1, wherein the first fixing member comprises a roller, wherein the third gear is disposed on an outer periphery of the roller.

5. The fixing device according to claim 1, wherein the second gear comprises:

a first surface that faces the first gear; and a protrusion protruding from the first surface, wherein the first gear comprises:

a second surface that faces the first surface of the second gear;

a third surface facing away from the second surface; and a first recess recessed from the second surface toward the third surface, the first recess being engageable with the protrusion.

6. The fixing device according to claim 5, wherein the first gear comprises:

a second recess recessed from the third surface toward the second surface, wherein the second recess is provided in a position angularly displaced from a position of the first recess about and axis of rotation of the first gear.

7. The fixing device according to claim 5, wherein the protrusion has a farthermost end farthest from the first surface, and a dimension from the first surface to the farthermost end is greater than a depth of the first recess.

8. The fixing device according to claim 1, wherein the second gear comprises the sleeve.

9. The fixing device according to claim 1, wherein the second gear has a hardness greater than a hardness of the first gear, and wherein the third gear has a hardness equal to or greater than the hardness of the second gear.

10. The fixing device according to claim 1, wherein the first gear is configured as a helical gear.

11. The fixing device according to claim 1, wherein each of the second gear and the third gear is configured as a spur gear.

12. The fixing device according to claim 1, wherein the first fixing member comprises a roller, wherein the second fixing member comprises:

a belt;

a pressure pad, the belt being disposed between the pressure pad and the roller; and a support member by which the pressure pad is supported.

13. An image forming apparatus comprising:

a developer image forming unit configured to form a developer image on a sheet;

a fixing device configured to fix the developer image on the sheet;

a housing in which the developer image forming unit and the fixing device are housed; and a main gear provided in the housing to transmit a driving force to the fixing device, wherein the fixing device comprises:

a first fixing member configured to rotate;

a second fixing member configured to form a nip in combination with the first fixing member;

a first gear configured to receive the driving force from the main gear;

a second gear configured to rotate together with the first gear about a center of rotation of the first gear;

a third gear provided in mesh with the second gear and configured to rotate together with the first fixing member;

a metal shaft by which the first gear and the second gear are rotatably supported;

a side frame supporting the first fixing member and the metal shaft; and a sleeve provided around the metal shaft, wherein a material of the second gear and a material of the sleeve have melting points higher than a melting point of a material of the first gear, and wherein the first gear is supported via the sleeve by the metal shaft.

14. The image forming apparatus according to claim 13, wherein the housing comprises a frame having a positioning slot for use in locating the fixing device in place, wherein the fixing device comprises a positioning protrusion engageable in the positioning slot, wherein the positioning slot has a bottom which contacts the positioning protrusion, and wherein a projection of the positioning protrusion engaged in the positioning slot in a direction of a vector of a force to be exerted from the main gear on the first gear overlaps the bottom of the positioning slot.

15. The image forming apparatus according to claim 13, wherein the housing comprises a frame having a positioning slot for use in locating the fixing device in place, wherein the metal shaft is engageable in the positioning slot, wherein the positioning slot has a bottom which contacts the metal shaft, and wherein a projection of the metal shaft engaged in the positioning slot in a direction of a vector of a force to be exerted from the main gear on the first gear overlaps the bottom of the positioning slot.

16. The image forming apparatus according to claim 13, wherein one of the first fixing member and the second fixing member comprises a movable member, and another of the first fixing member and the second fixing member comprises a stationary member, the movable member being configured to be movable relative to the stationary member, wherein the fixing device further comprises:

a spring by which the movable member is biased toward the stationary member;

a cam configured to cause the movable member to move against a biasing force of the spring; and a cam gear configured to rotate together with the cam, wherein the housing comprises a cam drive gear provided in mesh with the cam gear, and wherein the cam drive gear is located across the cam gear from the third gear.

17. The image forming apparatus according to claim 13, wherein the second gear comprises:

a first surface that faces the first gear; and a protrusion protruding from the first surface, wherein the first gear comprises:

a second surface that faces the first surface of the second gear;

a third surface facing away from the second surface; and a first recess recessed from the second surface toward the third surface, the first recess being engageable with the protrusion.

18. The image forming apparatus according to claim 17, wherein the protrusion has a farthermost end farthest from the first surface, and a dimension from the first surface to the farthermost end is greater than a depth of the first recess.

19. The image forming apparatus according to claim 13, wherein the second gear comprises the sleeve.

20. The image forming apparatus according to claim 13, wherein the first fixing member comprises a roller, wherein the second fixing member comprises:

a belt;

a pressure pad, the belt being disposed between the pressure pad and the roller; and a support member by which the pressure pad is supported.

* * * * *